US005450865A

United States Patent [19]

Park

[11] Patent Number: 5,450,865

[45] Date of Patent: Sep. 19, 1995

[54] MAKEUP BRUSH

[75] Inventor: Young-Soo Park, Tokyo, Japan

[73] Assignee: Y. S. Park New York Co., Ltd., Tokyo, Japan

[21] Appl. No.: 243,086

[22] Filed: May 16, 1994

Related U.S. Application Data

[63] Continuation of Ser. No. 101,092, Aug. 3, 1993, abandoned, which is a continuation of Ser. No. 976,707, Nov. 16, 1992, abandoned, which is a continuation of Ser. No. 762,172, Sep. 20, 1991, abandoned, which is a continuation of Ser. No. 611,808, Nov. 8, 1990, abandoned.

[51] Int. Cl.[6] ..... A45D 40/26

[52] U.S. Cl. ..... 132/218; 15/160; 132/216

[58] Field of Search ..... 132/216, 218, 320; 15/160, 167.3

[56] References Cited

U.S. PATENT DOCUMENTS

| | | | |
|---|---|---|---|
| D. 145,286 | 7/1946 | Crane | 132/320 X |
| 1,356,080 | 10/1920 | Mason, Jr. | 15/160 |
| 2,532,110 | 11/1950 | Lenz | 15/160 X |
| 4,452,262 | 6/1984 | Jankewitz | 132/320 |
| 4,602,650 | 7/1986 | Pipkin | 132/320 X |
| 4,796,647 | 1/1989 | Gueret | 132/320 |

FOREIGN PATENT DOCUMENTS

| | | | |
|---|---|---|---|
| 0890205 | 2/1944 | France | 15/167.3 |

*Primary Examiner*—Todd E. Manahan
*Assistant Examiner*—Jeffrey A. Smith
*Attorney, Agent, or Firm*—Armstrong, Westerman, Hattori, McLeland and Naughton

[57] ABSTRACT

The present invention relates to a makeup brush such as an eyebrow brush, an eyeshadow brush or the like that is capable of providing sharp lines and/or gradation of makeup when applied. The makeup brush as embodied in the present invention generally includes a shank and a brush tuft mounted on an end of the shank. The width of the brush tuft along its top surface as viewed from a plan view of the top surface tapers such that the width of one end of the brush tuft is greater than the width of the second end. In one embodiment of the present invention, the top surface of the brush tuft is defined along a first plane that forms an acute angle with a second plane in which a base portion of the brush tuft. The apex of the acute angle is substantially located near the second end of the brush tuft.

8 Claims, 1 Drawing Sheet

MAKEUP BRUSH

This application is a continuation of application Ser. No. 08/101,092 filed Aug. 3, 1993, which was a continuation of 07/976,707, filed Nov. 16, 1992, which was a continuation of 07/762,172, filed Sep. 20, 1991, which was a continuation of 07/611,808, filed Nov. 8, 1990, all of which are now abandoned.

BACKGROUND OF THE INVENTION

1. Field of the Invention

The present invention relates to a makeup brush such as an eyebrow brush, an eye shadow brush and the like for applying cosmetics, and more particularly to such a makeup brush that is capable of providing both sharp lines and gradations.

2. Prior Art

As is well known, makeup brushes include eyebrow combs for combing eyebrows, eyebrow pencils for drawing sharp lines, slender brushes for applying eyeliner, eyebrow brushes for providing gradations, cheek brushes, eye shadow brushes, and lipbrushes.

The above-mentioned makeup brushes are divided broadly into three categories, viz, makeup brushes for providing gradations, those for providing sharp lines, and the others such as the eyebrow comb for combing the eyebrow.

As a result of the large number of types of brushes, a beauty artist at a beauty salon who provides a professional makeup service, or a model who has to make up herself with very little time having to use different makeup brushes (i.e., a separate makeup brush for gradation and another one for providing a sharp line) are common occurrences. Having to use such separate brushes has resulted in problems that include inconvenience in practical handling thereof and higher cost required.

SUMMARY OF THE INVENTION

The present invention has been conceived in light of the above status and is directed to providing a less-expensive makeup brush which is capable of easily providing gradations or sharp lines.

For the purpose of achieving the above object, the makeup brush according to the present invention comprises a shank and a brush tuft fixed on one end of the shank, the tip portion of said brush tuft being formed an acute angle in plan view and both side portions of said brush tuft being configured to give respective planes to be used for providing a gradation or shading-off.

DETAILED DESCRIPTION AND THE PREFERRED EMBODIMENTS

Now, the present invention will be explained in detail with reference to the accompanying drawings.

Figure 1:
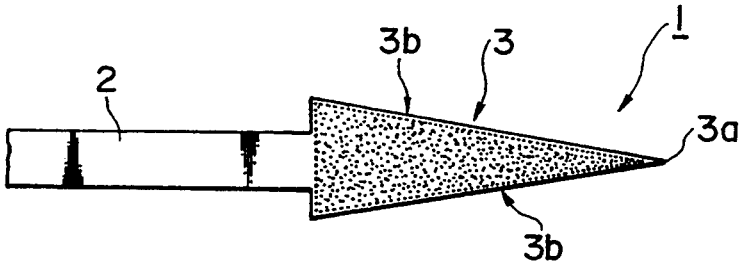
FIG. 1 is a plan view of an eyebrow brush according to a first embodiment of the present invention.
Figure 2:
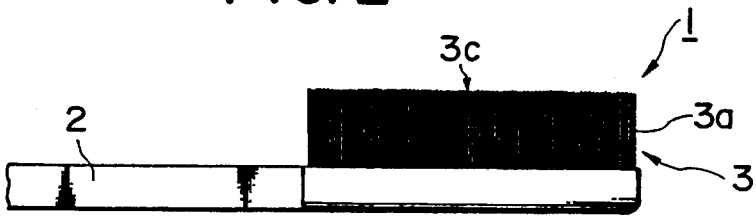
FIG. 2 is a front view of said eyebrow brush.

In FIGS. 1 and 2, there is illustrated an eyebrow brush 1 according to the first embodiment of the present invention. The eyebrow brush is composed of a shank 2 made of a synthetic resinous or wooden material to be easily grippable, and a brush tuft 3 planted on the upper face of one end of the shank 2.

The brush tuft 3 is composed of a number of planted hairs of the same length and, as shown in FIG. 1, its planar form is configured to provide an isosceles triangle. A tip portion 3*a* with an acute angle in plan view is capable of drawing a sharp line, while, the tapered side portions 3*b*, 3*b* and the upper face 3*c* are arranged to be capable of providing gradation or shading off. The tapered side portions 3*b*, 3*b* can naturally be formed in a gentle curve.

Figure 3:
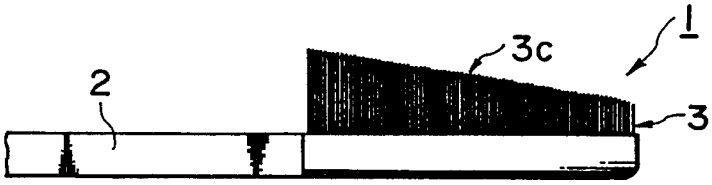
FIG. 3 is a front view showing a modification of said eyebrow brush.

In FIG. 3, there is illustrated a modification of the brush tuft 3 of the above eyebrow brush 1. In this modification, the lengh of the hairs of the brush tuft 3 is gradually shortened toward the tip portion 3*a* of the acute angle so that the upper face 3*c* (e.g., which is generally along a first plane which is at an angle with respect to a second plane at the side of the shank at which the brush tuft is mounted, e.g. as shown in FIG. 3) thereof is inclined down for the purpose of arranging the brush to be capable of easily drawing a sharp line. The construction and function of the modification of the invention are otherwise the same as those as in the above first embodiment.

Figure 4:
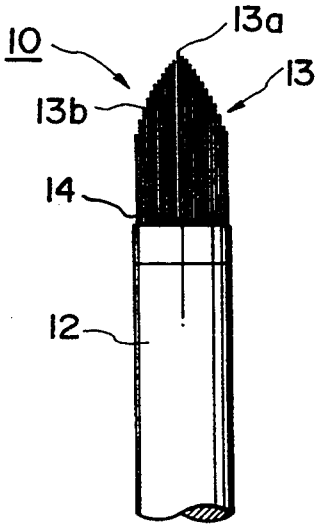
FIG. 4 is a plan view of a makeup brush according to a second embodiment of the present invention.
Figure 5:
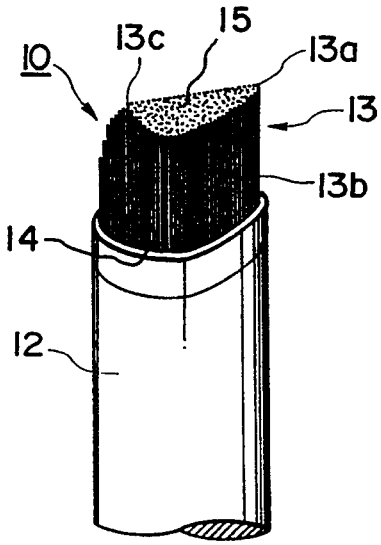
FIG. 5 is a propective view of said makeup brush.
Figure 6:
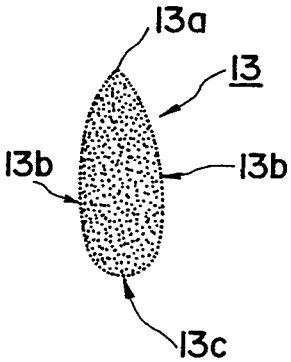
FIG. 6 is an enlarged view showing a profile of brush planes to be used for providing a gradation.

FIGS. 4, 5 and 6 illustrate a makeup brush 10 according to a second embodiment of the present invention, and the makeup brush 10 is composed of a shank 12 and a brush tuft 13 fixed on one end of the shank 12.

The brush tuft 13 is composed of a number of hairs bound at base portion 14 (e.g., at a first end, lower end, of the brush tuft) and fixed in the shank 12 (e.g., at a first side, upper side, of the brush tuft). The end face (e.g., the brush tuft end face 15 having a surface at a distal end, upper end, of the brush tuft opposite the first end, lower end, of the brush tuft) thereof as shown in FIG. 6 is configured to be substantially in a droplet form, and its tip portion 13*a* with an acute angle in plan view is capable of drawing a sharp line, while side planes 13*b*, 13*b* and an arcuate face portion 13*c* are arranged to be capable of providing a gradation or shading-off. The perimeter edge of the brush tuft end face, as shown in FIGS. 1 and 6, extends around the distal ends, upper ends, of the side surfaces of said brush tuft (such as at 3*a*, 3*b* and 13*a*, 13*b*, 13*c*). The perimeter edge has two opposite sides which taper towards one another to a narrower first side, i.e. tip (3*a* and 13*a*), from a wider second side, such as left to right in FIG. 1 and bottom to top (13*c* to 13*a*) in FIG. 6, whereby the brush tuft tapers in width.

By separately forming the side planes 13*b*, 13*b* and the arcuate face portion 13*c*, it is possible to easily adjust a shade of color in such a manner that the side planes 13*b*, 13*b* provide a light gradation by widely spreading a given cosmetic, while, the arcuate face portion 13*c* provides a dark gradation of a small extent.

In the above embodiments, the present invention is described with respect to the eyebrow brush and the makeup brush which employ hairs, However, it is not limited to such constructions but can be applied to makeup brushes, for example, an eyebrow comb whose brush tuft is made of a synthetic resinous material.

Further, the present invention is not limited to the above embodiments, but it is naturally possible, for example, to fix the makeup brushes according to the present invention on both ends of the shank or to fix the eyebrow brush according to the above first embodiment on one end of the shank and the makeup brush according to the above second embodiment on the other end.

Constructed as above, the makeup brush according to the present invention can provide such advantages that it is capable of drawing sharp lines and/or gradations without other aid. Accordingly, not only does the present invention allow makeup to be done in a short period of time and improves the usability thereof, but also there can be reduced cost since it serves for two makeup brushes which would otherwise be required in the prior art.

What is claimed is:

1. A makeup brush for providing sharp lines and gradation or shading-off of makeup, said makeup brush comprising:

(a) a shank;

(b) a brush tuft mounted at a first end of the brush tuft to a first side of said shank;

(c) said brush tuft extending from said first side of said shank;

(d) said brush tuft having a brush tuft end face surface at a distal end of said brush tuft opposite said first end of said brush tuft;

(e) said brush tuft end face surface being an applicator surface capable of applying makeup to an object;

(f) said brush tuft end face surface extending across said brush tuft and being defined by a perimeter edge which extends around distal ends of side surfaces of said brush tuft, said side surfaces extending to said shank;

(g) said perimeter edge having two opposite sides which taper towards one another such that said brush tuft end face surface tapers in width to form a tip at said perimeter edge on a first side of said brush tuft end face surface; and (h) said brush tuft end face surface being greater in width at a second side of said end face surface opposite said first side of said end face surface than at said first side of said brush tuft end face surface.

2. A makeup brush as claimed in claim 1, wherein:

(a) said brush tuft end face surface is defined generally along a first plane;

(b) said first side of said shank at which said brush tuft is mounted is defined generally along a second plane; and (c) said first and second planes intersect proximate said first side of said brush tuft end face surface such that the distance between said first side of said shank and said brush tuft end face surface decreases in height from said second side of said brush tuft end face surface to said first side of said brush tuft end face surface.

3. A makeup brush as claimed in claim 1, wherein said perimeter edge of said brush tuft end face defines the shape of a triangle.

4. A makeup brush as claimed in claim 3, wherein said triangle is an isosceles triangle having two equal length sides and said tip is at the vertex between said two equal length sides of said isosceles triangle.

5. A makeup brush as claimed in claim 1, wherein said brush tuft end face surface is a generally ovular droplet shape with said perimeter edge being generally rounded and tapering towards said tip.

6. A makeup brush as claimed in claim 5, wherein:

(a) said brush tuft end face surface is defined generally along a first inclined plane and a second inclined plane;

(b) said first inclined plane and said second inclined plane being at an acute angle to one another and intersecting at a line which extends generally centrally along said brush tuft end face surface from said second side of said brush tuft end face surface to said first side of said brush tuft end face surface; and (c) said acute angle forming a vertex which points away from said shank so as to form an increased central height of said brush tuft.

7. A makeup brush as claimed in claim 1, wherein said brush tuft is formed of a plurality of generally parallel hairs.

8. A makeup brush as claimed in claim 1, wherein said brush tuft is formed of a synthetic resinous material.

* * * * *